United States Patent [19]

Gregory

[11] Patent Number: 4,743,581

[45] Date of Patent: May 10, 1988

[54] THERMAL TRANSFER PRINTING

[75] Inventor: Peter Gregory, Bolton, England

[73] Assignee: Imperial Chemical Industries PLC, London, England

[21] Appl. No.: 909,849

[22] Filed: Sep. 22, 1986

[30] Foreign Application Priority Data

Oct. 1, 1985 [GB] United Kingdom ..... 852454

[51] Int. Cl.[4] ..... B41M 5/26

[52] U.S. Cl. ..... 503/227; 8/471; 427/146; 427/256; 428/195; 428/913; 428/914

[58] Field of Search ..... 8/470, 471; 346/227, 346/135.1; 427/146, 256; 428/185, 207, 411.1, 913, 914; 430/945; 503/227

[56] References Cited

U.S. PATENT DOCUMENTS 4,264,495 4/1981 Maher et al. ..... 260/152

FOREIGN PATENT DOCUMENTS 2099010 4/1982 United Kingdom ..... 346/227

*Primary Examiner*—Bruce H. Hess

*Attorney, Agent, or Firm*—Cushman, Darby & Cushman

[57] ABSTRACT

A thermal transfer printing sheet comprising a substrate having a coating comprising an azo dye of the formula:

$$A—N=N—B—N=N—E \qquad I$$

wherein:

A is the residue of a diazotisable phenylamine or naphthylamine, A-$NH_2$, carrying not more than one unsaturated electron-withrawing group;

B is an optionally substituted thiophen-2,5-ylene or thiazol-2,5-ylene group;

and E is the residue of an aromatic coupling component having a group displaceable by a diazotized aromatic amine, suitable use in a thermal transfer printing process of the type in which the transfer sheet is placed in contact with a material to be printed and selectively heated in accordance with a pattern information signal whereby dye from the selectively heated regions of the transfer sheet is transferred to the material to be printed and forms a pattern thereon the shape and density of which is in accordance with the pattern and intensity of heat applied to the transfer sheet.

10 Claims, No Drawings

THERMAL TRANSFER PRINTING

This specification describes an invention relating to thermal transfer printing (TTP), especially to a transfer sheet carrying a dye or dye mixture, and to a transfer printing process in which dye is transferred from the transfer sheet to a receiver sheet by the application of heat.

In the form of thermal transfer printing with which the present application is concerned, a heat-transferable dye is applied to a sheet-like substrate, in the form of an ink, usually containing a polymeric or resinous binder to bind the dye to the substrate, to form a transfer sheet. This is then placed in contact with the material to be printed, the receiver sheet, and selectively heated in accordance with a pattern information signal whereby dye from the selectively heated regions of the transfer sheet is transferred to the receiver sheet and forms a pattern thereon the shape and density of which is in accordance with the pattern and intensity of heat applied to the transfer sheet.

Important criteria in the selection of a dye for TTP are its thermal properties, brightness of shade, fastness properties, such as light and heat fastness, and facility for application to the substrate in the preparation of the transfer sheet. For suitable performance the dye should transfer evenly, in a predetermined relationship to the heat applied to the transfer sheet so that the depth of shade on the receiver sheet is smoothly related to the heat applied and a good density gradation can be achieved on the receiver sheet. Brightness of shade is important in order to obtain as wide a range of shades with the three primary dye shades of yellow, cyan and magenta.

As the dye must be sufficiently mobile to migrate from the transfer sheet to the receiver sheet at the temperatures employed, typically 150°–400° C., preferably 300°–400° C., for a period of from 1 to 10 milliseconds (msec), it is generally free from ionic and water-solubilising groups, and is thus not readily soluble in aqueous or water-miscible media, such as water and alkanols. Many suitable dyes are also not readily soluble in the solvents which are commonly used in, and thus acceptable to, the printing industry, such as aromatic hydrocarbons, alkanols and alkyl- and cycloalkyl-ketones. Although the dye can be applied as a dispersion in a suitable solvent, it has been found that brighter, glossier and smoother final prints can often be achieved on the receiver sheet if the dye is applied to the substrate from a solution. To apply sufficient dye to the transfer sheet, and thereby to achieve the potential for a deep shade on the receiver sheet, it is desirable that the dye should be readily soluble in the ink medium, particularly if it has a relatively low extinction coefficient. It is also important that a dye which has been applied to a transfer sheet from a solution should be resistant to crystallisation so that it remains as an amorphous layer on the transfer sheet for a considerable time.

According to a first aspect of the present invention there is provided a thermal transfer printing sheet comprising a substrate having a coating comprising an azo dye of the formula:

$$A—N=N—B—N=N—E \qquad I$$

wherein:

A is the residue of a diazotisable phenylamine or naphthylamine, $A—NH_2$, carrying not more than one unsaturated electron-withdrawing group;

B is an optionally substituted thiophen-2,5-ylene or thiazol-2,5-ylene group;

and E is the residue of an aromatic coupling component E—X wherein

X is a group displaceable by a diazotised aromatic amine.

The residue, A, of the amine, $A—NH_2$, is preferably a phenyl group which may be unsubstituted or substituted by nonionic groups, preferably those which are free from acidic hydrogen atoms unless these are positioned so that they form intramolecular hydrogen bonds. By the term unsaturated electron-withdrawing group is meant a group of at least two atoms containing at least one multiple (double or triple) bond and in which at least one of the atoms is more electronegative than carbon. Examples of preferred unsaturated electron-withdrawing groups are —CN; —SCN; $—NO_2$; $—CONT_2$; $—SO_2NT_2$; $—COT^1$; $—SO_2T^1$; $—COOT^2$; $—SO_2OT^2$; —COF; —COCl; $—SO_2F$ and $—SO_2Cl$, wherein each T is independently H, $C_{1-4}$-alkyl or phenyl, $T^1$ is $C_{1-4}$—alkyl or phenyl and $T^2$ is $C_{1-4}$—alkyl.

Examples of other suitable substituents which may be carried by A in place of, or in addition to, the unsaturated electron-withdrawing group are $C_{1-4}$—alkyl, $C_{1-4}$—alkoxy, $C_{1-4}$—alkoxy—$C_{1-4}$—alkyl; $C_{1-4}$—alkoxy—$C_{1-4}$—alkoxy; $—NT_2$; halogen, especially Cl, Br and F; $CF_3$; cyano-$C_{1-4}$—alkyl and $C_{1-4}$—alkylthio.

It is preferred that A is of the formula:

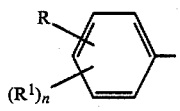

II wherein

R is selected from H, CN, SCN, $NO_2$, $—CONT_2$—, $—SO_2NT_2$, $—COT^1$, $—SO_2T^1$, $—COOT^2$, $—SO_2OT^2$, COF, —COCl, $—SO_2F$, $—SO_2Cl$;

each $R^1$ is independently selected from H; $C_{1-4}$—alkyl; $C_{1-4}$—alkoxy; F; Cl; Br; $CF_3$ and $—NT_2$.

and n is 1, 2 or 3.

Examples of phenyl and naphthyl groups represented by A are phenyl, 2-chlorophenyl, 4-chlorophenyl, 2,4-dichlorophenyl, 2-trifluoromethyl-4-chlorophenyl, 3,4-dichlorophenyl, 2-bromophenyl, 2-nitrophenyl, 4-nitrophenyl, 2-cyanophenyl, 3-cyanophenyl, 4-cyanophenyl, 2-trifluoromethylphenyl, 4-(methoxycarbonyl)phenyl, 4-(ethoxycarbonyl)phenyl, 4-methylphenyl, 3-methylphenyl, 4-(methylsulphonyl)phenyl, 4-thiocyanophenyl, 2-chloro-4-nitrophenyl and 1-naphthyl.

The optionally substituted thiophen-2,5-ylene or thiazol-2,5-yl group, B, is preferably derived from a 2-aminothiophene or 2-aminothiazole having a hydrogen atom or a group displaceable by a diazotised amine in the 5-position and optionally other non-ionic substituents present in the 3 and/or 4 positions. Examples of suitable substituents for the 3 and 4 positions are those given above for A. Especially preferred substituents for the 4-position are $C_{1-4}$—alkyl; $C_{1-4}$—alkoxy; aryl, especially phenyl and $NO_2$—phenyl; $C_{1-4}$—alkoxy—CO; $C_{1-4}$alkoxy—$C_{1-4}$—alkoxy—CO— and halogen. Especially preferred substituents for the 3-position of the thiophen-2,5-ylene group are CN; $NO_2$; $—CONT_2$;

—$SO_2NT_2$; —$COT^1$ and —$SO_2T^1$ and those given above for the 4-position.

It is preferred that B is a group of the formula:

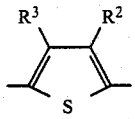

III wherein $R^2$ is selected from CN, —$COOT^1$, —$COT^1$ and —$CONT_2$;
and $R^3$ is H or $C_{1-4}$—alkyl.

It is especially preferred that $R^2$ is —CN; acetyl; methoxycarbonyl; ethoxycarbonyl or dimethylaminocarbonyl and $R^3$ is H or methyl.

Examples of suitable 2-aminothiophenes and 2-aminothiazoles are:
2-amino-3-cyanothiophene
2-amino-3-cyano-4-methylthiophene
2-amino-3-acetylthiophene
2-amino-3-(ethoxycarbonyl)thiophene
2-amino-3-(aminocarbonyl)thiophene
2-amino-3-(dimethylaminocarbonyl)thiophene
2-aminothiazole
2-amino-4-methylthiazole The coupling component, which is preferably of the formula, E—H, in which X is a displaceable hydrogen atom. It is further preferred that the coupling component is an optionally substituted aniline, naphthylamine, diaminopyridine, aminoheteroaromatic, such as tetrahydroquinoline and julolidine, or hydroxypyridone. Especially preferred coupling components are optionally substituted anilines and tetrahydroquinolines. Examples of suitable substituents for the rings of these systems are $C_{1-4}$—alkyl, $C_{1-4}$—alkoxy; $C_{1-4}$—alkyl— and phenyl—NH—CO—; $C_{1-4}$alkyl— and phenyl—CO—NH—; halogen, especially Cl and Br; $C_{1-4}$—alkyl—CO—O—$C_{1-4}$—alkyl; $C_{1-4}$—alkoxy—$C_{1-4}$—alkyl and cyano—$C_{1-4}$—alkyl. It is preferred that E is a 4-aminophenyl group preferably having one or two optionally substituted $C_{1-4}$—alkyl groups attached to the amino group and optionally carrying one ring substituent in the 3-position or two ring substituents in the 2 and 5 positions with respect to the amino group. Preferred ring substituents are $C_{1-4}$—alkyl, especially methyl; $C_{1-4}$—alkoxy, especially methoxy or ethoxy and $C_{1-4}$—alkyl—CONH—, especially acetylamino. Preferred substituents for the amino group are independently selected from $C_{1-4}$—alkyl, especially ethyl and/or butyl; aryl, especially phenyl; $C_{4-8}$—cycloalkyl; and $C_{1-4}$—alkyl substituted by a group selected from OH; CN; halogen, especially F, Cl or Br; aryl, especially phenyl; $C_{1-4}$—alkoxy—$C_{1-4}$—alkoxy; $C_{1-4}$—alkoxy, $C_{1-4}$—alkyl—CO—, $C_{1-4}$—alkoxy—CO—, $C_{1-4}$—alkyl—COO—, $C_{1-4}$—alkoxy—O—$C_{1-4}$—alkoxy—CO— and $C_{1-4}$—alkoxy—COO—.

It is especially preferred that E is a group of the formula:

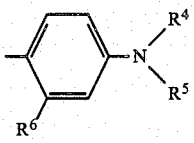

IV wherein $R^4$ and $R^5$ are independently selected from H, $C_{1-4}$—alkyl, aryl,
$C_{4-8}$—cycloalkyl and $C_{1-4}$—alkyl substituted by a group selected from OH, CN, halogen, aryl, $C_{1-4}$—alkoxy, $C_{1-4}$—alkoxy—$C_{1-4}$—alkoxy, $C_{1-4}$—alkyl—CO—, $C_{1-4}$—alkoxy—CO—,
$C_{1-4}$—alkyl—COO—, $C_{1-4}$—alkoxy—$C_{1-4}$—alkoxy—CO—,
$C_{1-4}$—alkoxy—COO—; and $R^6$ is selected from H, $C_{1-4}$—alkyl, $C_{1-4}$—alkoxy and —$NHCOT^1$.

The aryl group represented by, or contained in, $R^4$ and/or $R^5$ is preferably phenyl or substituted phenyl, examples of suitable substituents being those given above for A.

It is preferred that $R^4$ and $R^5$ are $C_{2-4}$—alkyl which may be the same or different and, more especially, that $R^4$ is ethyl and $R^5$ is n-propyl or n-butyl, or that $R^4$ and $R^5$ are both ethyl or both n-propyl or both n-butyl. It is also preferred that $R^6$ is H, methyl or, more especially, acetylamino.

Examples of coupling components represented by E—H are:
N,N-diethylaniline
N-n-butyl-N-ethylaniline
3-methyl-N,N-diethylaniline
3-methyl-N,N-di(2-acetoxyethyl)aniline
3-methyl-N-ethyl-N-benzylaniline
3-methyl-N-n-butyl-N-2-(ethoxycarbonyl)ethylaniline
3-methyl-N-n-butyl-N-[3-(ethoxycarbonyl)propyl]aniline
3-methyl-N,N-di(n-propyl)aniline
3-methyl-N-n-butyl-N-ethylaniline
3-methoxy-N,N-diethylaniline
3-methoxy-N,N-di(2-[ethoxycarbonyl]ethyl)aniline
3-acetylamino-N,N-diethylaniline
3-acetylamino-N,N-di(n-butyl)aniline
3-acetylamino-N-ethyl-N-(n-butyl)aniline
N,N-di(2-acetoxyethyl)aniline
N,N-di(2-cyanoethyl)aniline
N-ethyl-N-cyanoethylaniline.

A preferred sub-class of dyes according to the present invention conform to the formula:

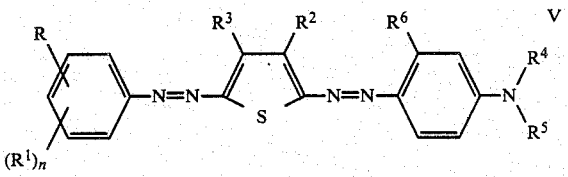

V wherein
R is selected from H; —CN; —$NO_2$; —$CONT_2$—; —$SO_2NT_2$; —$COT^1$; —$SO_2T^1$; $COOT^2$ and $SO_2OT^2$;
each $R^1$ is independently selected from H; halogen, especially F, Cl or Br; $CF_3$; $C_{1-4}$—alkyl; $C_{1-4}$—alkoxy; —$NT_2$;
n is 1, 2 or 3;
$R^2$ is selected from CN, —$COT^1$, —$CONT_2$ and $COOT^1$;
$R^3$ is H or $C_{1-4}$—alkyl;
$R^4$ and $R^5$ are independently selected from H, $C_{1-4}$—alkyl, phenyl,
$C_{4-8}$—cycloalkyl and $C_{1-4}$—alkyl substituted by a group selected from OH, CN, $C_{1-4}$—alkoxy, $C_{1-4}$—alkoxy—$C_{1-4}$—alkoxy,
$C_{1-4}$—alkyl—CO—, $C_{1-4}$—alkoxy—CO—, $C_{1-4}$—alkyl—COO—, halogen, $C_{1-4}$—alkoxy—$C_{1-4}$—alkoxy—CO—, $C_{1-4}$—alkoxy—COO— and phenyl;

and $R^6$ is selected from H, $C_{1-4}$—alkyl, $C_{1-4}$—alkoxy and —NHCOT[1].

When there are two substituents selected from R and $R^1$ these are preferably in the 2 and 4 or 3 and 4 positions and where there are three substituents selected from R and $R^1$ these are preferably in the 2, 4 and 6 positions.

In an especially preferred class of dye within Formula V, R is selected from H, CN, $C_{1-4}$—alkyl—$SO_2$— and $C_{1-4}$—alkoxy—CO—; $R^1$ is selected from H, Cl, Br, $CF_3$, $C_{1-4}$—alkyl; $R^2$ is CN; $R^3$ is H or methyl; $R^6$ is $C_{1-4}$—alkyl—CONH—; and n=1.

Another preferred class of dye within Formula V is that in which R and $R^3$ are H, n is 2 and each $R^1$ is independently selected from H; halogen, especially F, Cl, or Br; $C_{1-4}$—alkyl; $C_{1-4}$—alkoxy and $CF_3$.

A further preferred sub-class of dyes according to the present invention conform to the formula:

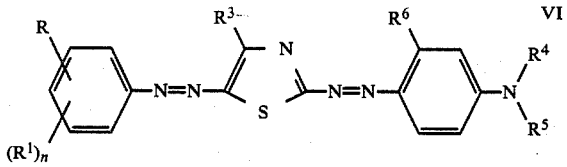

VI wherein

R is selected from H; —CN; —$NO_2$; —$CONT_2$; —$SO_2NT_2$; —$COT^1$; —$SO_2T^1$; $COOT^2$ and $SO_2OT^2$;

$R^1$ is selected from H; halogen; $CF_3$; $C_{1-4}$—alkyl; $C_{1-4}$—alkoxy; —$NT_2$;

n is 1, 2 or 3;

$R^3$ is H or $C_{1-4}$—alkyl;

$R^4$ and $R^5$ are independently selected from H, $C_{1-4}$—alkyl, phenyl, $C_{4-8}$—cycloalkyl and $C_{1-4}$—alkyl substituted by a group selected from OH, CN, $C_{1-4}$—alkoxy, $C_{1-4}$—alkoxy—$C_{1-4}$—alkoxy, $C_{1-4}$—alkyl—CO—, $C_{1-4}$—alkoxy—CO—, $C_{1-4}$—alkyl—COO—, halogen, $C_{1-4}$—alkoxy—$C_{1-4}$—alkoxy—CO—, $C_{1-4}$—alkoxy—COO— and phenyl;

and $R^6$ is selected from H, $C_{1-4}$—alkyl, $C_{1-4}$—alkoxy and —NHCOT[1].

Preferred dyes of Formula VI are those in which R and $R^1$ are H, $R^3$ is H or methyl, $R^4$ and $R^5$ are selected from ethyl, n-propyl or n-butyl and $R^6$ is H, methyl or acetylamino.

Examples of specific dyes according to Formula V are shown in Table 1.

TABLE 1

| Dye | R | $R^1$ | $R^2$ | $R^3$ | $R^4$ | $R^5$ | $R^6$ |
|---|---|---|---|---|---|---|---|
| 1 | H | H | CN | H | $C_2H_5$ | $C_2H_5$ | $NHCOCH_3$ |
| 2 | H | H | CN | H | n-$C_4H_9$ | n-$C_4H_9$ | $NHCOCH_3$ |
| 3 | H | H | CN | H | $C_2H_5$ | n-$C_4H_9$ | $NHCOCH_3$ |
| 4 | 2-CN | H | CN | H | $C_2H_5$ | $C_2H_5$ | $NHCOCH_3$ |
| 5 | 3-CN | H | CN | H | $C_2H_5$ | $C_2H_5$ | $NHCOCH_3$ |
| 6 | H | H | CN | H | $C_2H_4OCOCH_3$ | $C_2H_4OCOCH_3$ | H |
| 7 | H | H | $CON(CH_3)_2$ | H | $C_2H_5$ | $C_2H_5$ | $NHCOCH_3$ |
| 8 | H | H | $CON(CH_3)_2$ | H | $C_2H_5$ | $C_2H_5$ | $CH_3$ |
| 9 | H | H | CN | H | $C_2H_5$ | $C_2H_5$ | $CH_3$ |
| 10 | 2-CN | H | CN | H | $C_2H_5$ | $C_2H_5$ | $CH_3$ |
| 11 | 3-CN | H | CN | H | $C_2H_5$ | $C_2H_5$ | $CH_3$ |
| 12 | H | H | CN | H | $C_2H_5$ | $CH_2C_6H_5$ | $CH_3$ |
| 13 | H | H | CN | H | $C_2H_5$ | $C_2H_4OC_2H_5$ | $CH_3$ |
| 14 | H | 4-Cl | CN | H | $C_2H_5$ | $C_2H_5$ | $NHCOCH_3$ |
| 15 | H | H | $COCH_3$ | H | $C_2H_5$ | $C_2H_5$ | $NHCOCH_3$ |
| 16 | H | H | $COCH_3$ | H | $C_2H_5$ | $C_2H_5$ | $CH_3$ |
| 17 | H | H | $CO_2Et$ | H | $C_2H_5$ | $C_2H_5$ | $NHCOCH_3$ |
| 18 | H | H | $CO_2Et$ | H | $C_2H_5$ | $C_2H_5$ | $CH_3$ |
| 19 | H | H | CN | $CH_3$ | $C_2H_5$ | $C_2H_5$ | $NHCOCH_3$ |
| 20 | H | H | CN | $CH_3$ | $C_2H_5$ | $C_2H_5$ | $CH_3$ |
| 21 | H | H | CN | $CH_3$ | $C_2H_5$ | $C_2H_5$ | H |
| 22 | H | H | CN | $CH_3$ | $C_2H_5$ | n-$C_4H_9$ | $NHCOCH_3$ |
| 23 | H | H | CN | $CH_3$ | $C_2H_5$ | n-$C_4H_9$ | $CH_3$ |
| 24 | H | 3,4-diCl | CN | H | $C_2H_5$ | $C_2H_5$ | $NHCOCH_3$ |
| 25 | H | 4-$CH_3$ | CN | H | $C_2H_5$ | $C_2H_5$ | $NHCOCH_3$ |
| 26 | H | 4-$CH_3$ | CN | H | $C_2H_5$ | $C_2H_5$ | $CH_3$ |
| 27 | H | 3-$CH_3$ | CN | H | $C_2H_5$ | $C_2H_5$ | $NHCOCH_3$ |
| 28 | H | H | CN | H | $C_2H_5$ | $C_2H_4CN$ | H |
| 29 | H | 4-Cl | CN | H | $C_2H_5$ | $C_2H_5$ | $CH_3$ |
| 30 | H | H | CN | H | $C_2H_5$ | $C_2H_5$ | H |
| 31 | 4-$NO_2$ | H | CN | H | $C_2H_5$ | $C_2H_4CN$ | H |
| 32 | 4-CN | H | CN | H | $C_2H_5$ | $C_2H_5$ | $NHCOCH_3$ |
| 33 | 2-CN | H | CN | H | $C_2H_5$ | $C_2H_5$ | $NHCOC_2H_5$ |
| 34 | H | H | CN | H | $C_2H_5$ | $C_2H_4COOCH_3$ | H |

Examples of specific dyes according to Formula VI are shown in Table 2:

TABLE 2

| Dye | R | $R^1$ | $R^2$ | $R^3$ | $R^4$ | $R^5$ | $R^6$ |
|---|---|---|---|---|---|---|---|
| 35 | H | H | — | H | $C_2H_5$ | $C_2H_5$ | $CH_3$ |
| 36 | H | H | — | H | $C_2H_5$ | $C_2H_5$ | $NHCOCH_3$ |
| 37 | H | H | — | $CH_3$ | $C_2H_5$ | $C_2H_5$ | $CH_3$ |
| 38 | H | H | — | $CH_3$ | $C_2H_5$ | $C_2H_5$ | $NHCOCH_3$ |

The dyes of Formulae I and V generally have absorption maxima in the region 580–700 nm and are useful for the printing of blue to bluish green shades, and especially for a cyan shade, as employed in trichromatic printing. Another important shade in trichromatic printing is black and the present dyes, especially those with absorption maxima in the range 580–660 nm, can be used to prepare black shades by admixture with dyes having orange shades.

Suitable monoazo dyes orange for this purpose include substituted phenylazopyridones and phenylazoanilines of the formulae:

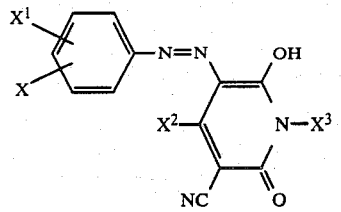

VII

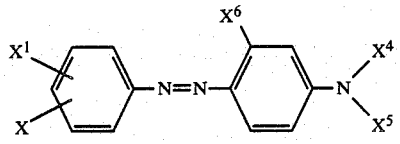

VIII wherein

X and $X^1$ are independently selected from H, $C_{1-4}$-alkyl, $C_{1-4}$—alkoxy and $NO_2$, $X^2$ is $C_{1-4}$—alkyl;

$X^3$ is $C^{1-10}$—alkyl;

$X^4$ and $X^5$ are independently selected from H, $C_{1-4}$—alkyl, phenyl, $C_{4-8}$—cycloalkyl and $C_{1-4}$—alkyl substituted by a group selected from OH, CN, $C_{1-4}$—alkoxy, $C_{1-4}$—alkoxy—$C_{1-4}$—alkoxy, $C_{1-4}$—alkyl—CO—, $C_{1-4}$—alkoxy—CO—, $C_{1-4}$—alkyl—COO—, halogen, $C_{1-4}$—alkoxy—$C_{1-4}$—alkoxy—CO—, $C_{1-4}$—alkoxy—COO— and phenyl;

and $X^6$ is selected from H, $C_{1-4}$—alkyl, $C_{1-4}$—alkoxy and —$NHCOT^1$.

In preferred dyes according to Formulae VII and VIII, X is H or $NO_2$ in the 2 or 4 positions with respect to the azo link and $X^1$ is H, methyl or methoxy. In a preferred dye according to Formula VII, $X^2$ is methyl and $X^3$ is methyl, ethyl, n-butyl or 2-ethylhexyl. In a preferred dye according to Formula VIII, $X^4$ is 2-cyanoethyl and $X^5$ is ethyl or 2-acetoxyethyl and $X^6$ is H.

It is however preferred to use disazo orange dyes because these have more similar fastness and printing properties to the blue dye of Formulae I, V and VI. In particular they enable dyes having strong, highly lightfast black shades to be obtained. Preferred disazo orange dyes are of the formula:

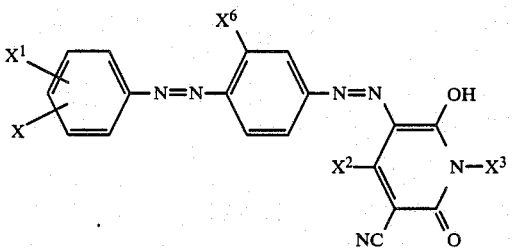

IX wherein X, $X^1$, $X^2$, $X^3$ and $X^6$ have the hereinbefore defined meanings.

Preferred dyes of Formula IX are those in which X is H or $NO_2$ in the 2 or 4 positions with respect to the azo link and $X^1$ is H, methyl or methoxy; $X^2$ is methyl; $X^3$ is methyl, ethyl, n-butyl or 2-ethylhexyl; and $X^6$ is H.

Specific examples of orange dyes according to Formulae VII, VIII and IX are:

1-(2-ethylhexyl)-3-cyano-4-methyl-5-(2-nitro-4-methoxyphenylazo)-6-hydroxypyrid-2-one 4-(nitrophenylazo)-N-ethyl-N-(2cyanoethyl)aniline 4-(nitrophenylazo)-N-(2-cyanoethyl)-N-(2-acetoxyethyl)aniline 1-n-butyl-3-cyano-4-methyl-5-(4-phenylazophenylazo)-6-hydroxypyrid-2-one.

The relative proportions of the blue dye of Formulae I, V or VI and the orange dye of Formula VII, VIII or IX required to produce a mixture giving a black shade depends on the shades and relative strengths of the components and the precise shade of black required.

The present dyes have high molecular weights and are not readily sublimable. It is, therefore, surprising that they give excellent prints in TTP, i.e. even coloration with depth of shade in good relationship to the applied heat and thus an even gradation of colour density. The dyes are capable of giving strong, bright shades under normal TTP application conditions, with very high lightfastness. The good lightfastness, which is rare in dyes suitable for TTP, is especially surprising for the present dyes in which $R^3$ is $C_{1-4}$—alkyl—CONH— because two commercial dyes (3-acetylamino-4-[5-ethylthiothiadiazol-2-ylazo]-N,N-diethylaniline and 3-acetylamino-4-[3,4-dicyanophenylazo]-N,N-diethylaniline) which contain a group of this type, have high lightfastness (5–6) on polyester fibre but low lightfastness (<2) on TTP receiver sheets.

In addition to their strong and bright shades, the present dyes have high solubilities in a wide range of solvents, especially those solvents which are widely used and accepted in the printing industry, such as alkanols, e.g. ethanol, isopropanol and butanol, aromatic hydrocarbons, such as toluene and ketones such as MEK, MIBK and especially cyclohexanone. This facilitates the application of the dye to the substrate from a solution and thus aids in the achievement of bright, glossy prints on the receiver sheet. The combination of good coloristic properties and high solubility in the preferred solvents allows the achievement of deep and even shades.

The substrate may be any convenient sheet material capable of withstanding the temperatures involved in TTP, up to 400° C. over a period of up to 20 msec, yet thin enough to transmit heat applied on one side through to the dye on the other side to effect transfer to a receiver sheet within such short periods, typically from 1 to 10 msec. Examples of suitable materials are paper, especially high quality paper of even thickness, such as capacitor paper, polyester, polyacrylate, polyamide, polyurethane, polyacrylonitrile, cellulosic and polyalkylene films, metallised forms thereof, including co-polymer and laminated films, especially laminates incorporating a polyester layer on which the dye is deposited. Such laminates preferably comprise, in addition to the polyester, a backcoat of a heat-resistant material, such as a thermosetting resin, e.g. silicone or polyurethane, to separate the heat source from the polyester so that the latter is not melted. The thickness of the substrate may vary within wide limits depending upon its thermal characteristics but is preferably less than 50 μm and more preferably below 10 μm.

The coating preferably comprises a binder and one or more dyes of Formula I, V or VI or mixtures thereof with dyes of VII, VIII and/or IX. The ratio of binder to dye is preferably at least 1:1 and more preferably from 1.5:1 to 4:1 in order to provide good adhesion between the dye and the substrate and inhibit migration of the dye during storage.

The binder may be any resinous or polymeric material suitable for binding the dye to the substrate. Examples of suitable binders are cellulose derivatives, such as ethylhydroxyethylcellulose (EHEC), hydroxypropylcellulose (HPC), ethylcellulose, methyl-cellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic.

The coating may also contain other additives, such as curing agents, preservatives, etc., these and other ingredients being described more fully in EP 133011A, EP 133012A and EP 111004A.

According to a further feature of the present invention there is provided a transfer printing process which comprises contacting a transfer sheet coated with a dye or Formula I with a receiver sheet, so that the dye is adjacent to the receiver sheet, and selectively heating an area of the transfer sheet whereby dye in the heated area of the transfer sheet may be selectively transferred to the receiver sheet.

The transfer sheet is preferably heated to a temperature from 200° C. to 400° C., more preferably >300° C., for a period of from 0.5 to 20 msec, more preferably from 1 to 10 msec while it is maintained in contact with the receiver sheet. The depth of shade of print on any area of the receiver sheet will vary with the time period for which the transfer sheet was heated while in contact with that area of the receiver sheet.

The receiver sheet conveniently comprises a white polyester substrate, especially polyethylene terephthalate (PET). Although dyes of Formula I are known for the colouration of textile materials made from PET, the colouration of textile materials, by dyeing or printing, is carried out under such conditions of time and temperature that the dye can to penetrate the PET and become fixed therein. In thermal transfer printing the time period is so short that penetration of the PET is less effective and the substrate is preferably provided with a receptive layer, on the side to which the dye is applied, into which the dye more readily diffuses to form a stable image on the receiver sheet. Such a receptive coating may comprise a thin layer, applied by co-extrusion or solution coating techniques, of a modified polyester or different polymeric material which is more permeable to the dye than the substrate. The nature of the receptive coating will affect to some extent the depth of shade and quality of the print obtained but it has been found that the present dyes give particularly strong and good quality prints compared with other dyes proposed for thermal transfer printing on any specific receiver sheet. The design of receiver sheets with receptive layers is discussed in EP 133,011 and EP 133012.

The invention is further illustrated by the following examples in which all parts are by weight unless otherwise indicated.

Ink 1

To a solution of 0.1 g of Dye 1,3-acetylamino-4-(3-cyano-5-phenylazothiophen-2-yl)-N,N-diethylaniline, in 5 ml of chloroform was added 9.5 ml of a 2.7% solution of EHEC (extra-low viscosity grade) in chloroform.

A further 16 inks were prepared according to the same method as Ink 1 using Dyes 2 to 13 as defined in Table 1 in place of Dye 1. If the dye did not dissolve readily the mixture was heated to 40° C. and stirred until the dye had completely dissolved after which it was allowed to cool and stand at ambient temperature for at least 2 hours before use. These inks are hereinafter referred to as Inks 2 to 13.

Inks 14 to 18

The following five inks were prepared by dissolving 0.1 g of Dye 1 in a solution of 0.2 g of EHEC (extra low) in 9.7 g of solvent and stirring at 40° C. for 1 hour.

| Ink | Solvent |
|---|---|
| 14 | 50:50 MEK/Cyclohexanone |
| 15 | 20:80 THF/Cyclohexanone |
| 16 | 100% Cyclohexanone |
| 17 | 50:50 Toluene/Cyclohexanone |
| 18 | 50:50 MEK/Toluene |

EXAMPLE 1

A transfer sheet was prepared by applying Ink 1 to a sheet of 6μ thick polyethylene terephthalate using a wire-wound metal Meyer-bar to produce a 24 micron wet film of ink on the surface of the sheet. The ink was dried with hot air and the sheet is hereinafter referred to as TS1.

EXAMPLES 2 TO 18

A further 17 transfer sheets were prepared by the method of Example 1 using Inks 2 to 18 in place of Ink 1. These transfer sheets are hereinafter referred to as TS2 to TS18.

EXAMPLE 19

A sample of TS1 was sandwiched with a receiver sheet, comprising a composite structure based on a white polyester base having a receptive coating layer on the side in contact with the printed surface of TS1. The sandwich was placed on the drum of a transfer printing machine and passed over a matrix of closely-spaced pixels which were selectively heated in accordance with a pattern information ignal to a temperature of >300° C. for periods from 2 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet. The printed receiver sheet is hereinafter referred to as RS1.

EXAMPLES 20 TO 36

A further 17 receiver sheets were prepared by the method of Example 19 using the transfer sheets TS2 to TS18 in place of TS1. The resulting receiver sheet are hereinafter referred to as RS2 to RS18.

Assessment of Inks and Transfer and Receiver Sheets

The stability of each ink and the quality of the print on the transfer sheet was assessed by visual inspection. An ink was considered stable if there was no precipitation over a period of two weeks at ambient and a transfer sheet was considered stable if it remained substantially free from crystallisation for a similar period. The quality of the printed impression on the receiver sheet was assessed in respect of reflected colour density by means of a densitometer (Sakura Digital densitometer). The results of the assessments are set out in Table 3.

TABLE 3

| Ex No | Ink Stability | Transfer Sheet Stability | Receiver Sheet Colour Density |
|---|---|---|---|
| 1/19 | 1 Stable | TS1 Stable | RS1 1.7 |
| 2/20 | 2 Stable | TS2 Stable | RS2 1.4 |
| 3/21 | 3 Stable | TS3 Stable | RS3 1.6 |
| 4/22 | 4 Stable | TS4 Stable | RS4 1.3 |
| 5/23 | 5 Stable | TS5 Stable | RS5 1.3 |
| 6/24 | 6 Stable | TS5 Stable | RS6 1.1 |
| 7/25 | 7 Stable | TS7 Stable | RS7 1.5 |
| 8/26 | 8 Stable | TS8 Stable | RS8 1.3 |
| 9/27 | 9 Stable | TS9 Stable | RS9 1.5 |
| 10/28 | 10 Stable | TS10 Stable | RS10 1.6 |
| 11/29 | 11 Stable | TS11 Stable | RS11 1.7 |
| 12/30 | 12 Stable | TS12 Stable | RS12 1.4 |
| 13/31 | 13 Stable | TS13 Stable | RS13 1.6 |
| 14/32 | 14 Stable | TS14 Stable | RS14 2.1 |
| 15/33 | 15 Stable | TS15 Stable | RS15 2.0 |
| 16/34 | 16 Stable | TS16 Stable | RS16 2.0 |
| 17/35 | 17 Stable | TS17 Stable | RS17 1.9 |
| 18/36 | 18 Stable | TS18 Stable | RS18 1.9 |

I claim:

1. A thermal transfer printing sheet comprising a substrate having a coating comprising an azo dye and a binder in which the azo dye is of the formula:

$$A—N=N—B—N=N—E \qquad \text{I}$$

wherein:

A is the residue of a diazotisable phenylamine or naphthylamine, $A—NH_2$, carrying not more than one unsaturated electron-withdrawing group;

B is an optionally substituted thiophen-2,5-ylene or thiazol-2,5-ylene group;

and E is the residue of an aromatic coupling component E—X wherein X is a group displaceable by a diazotised aromatic amine.

2. A thermal transfer printing shetter according to claim 1 wherein A is of the formula:

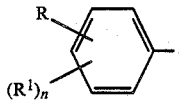

II wherein

R is selected from H, CN, SCN, $NO_2$, $—CONT_2—$, $—SO_2NT_2$, $—COT^1$, $—SO_2T^1$, $—COOT^2$, $—SO_2OT^2$, COF, —COCl, $—SO_2F$, $—SO_2Cl$;

each $R^1$ is independently selected from H; $C_{1-4}$—alkyl; $C_{1-4}$—alkoxy; F; Cl; Br; $CF_3$ and $—NT_2$.

n is 1, 2 or 3.

each T is independently H, $C_{1-4}$—alkyl or phenyl;

$T^1$ is $C_{1-4}$—alkyl or phenyl;

and $T^2$ is $C_{1-4}$—alkyl.

3. A transfer printing sheet according to claim 2 wherein B is a group of the formula:

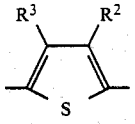

III wherein $R^2$ is selected from CN, $—COOT^1$, $—COT^1$ and $—CONT^2$;

$R^3$ is H or $C_{1-4}$—alkyl;

and T and $T^1$ are as defined in claim 2.

4. A transfer printing sheet according to claim 2 wherein E is a group of the formula:

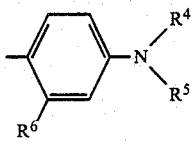

IV wherein $R^4$ and $R^5$ are independently selected from H, $C_{1-4}$—alkyl, aryl, $C_{4-8}$—cycloalkyl and $C_{1-4}$—alkyl substituted by a group selected from OH, CN, halogen, aryl, $C_{1-4}$—alkoxy, $C_{1-4}$—alkoxy—$C_{1-4}$alkoxy, $C_{1-4}$—alkyl—CO—, $C_{1-4}$—alkoxy—CO—, $C_{1-4}$—alkyl—COO—, $C_{1-4}$—alkoxy—$C_{1-4}$—alkoxy—CO—, $C_{1-4}$—alkoxy—COO—;

$R^6$ is selected from H, $C_{1-4}$—alkyl, $C_{1-4}$—alkoxy and $—NHCOT^11$ and $T^1$ is as defined in claim 2.

5. A transfer printing sheet according to claim 1 wherein B is a group of the formula:

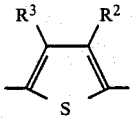

III wherein $R^2$ is selected from CN, $—COOT^1$, $—COT^1$ and $—CONT_2$;

$R^3$ is H or $C_{1-4}$—alkyl;

and T and $T^1$ are as defined in claim 2.

6. A transfer printing sheet according to claim 5 wherein E is a group of the formula:

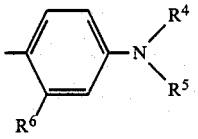

IV wherein $R^4$ and $R^5$ are independently selected from H, $C_{1-4}$—alkyl, aryl, $C_{4-8}$—cycloalkyl and $C_{1-4}$—alkyl substituted by a group selected from OH, CN, halogen, aryl, $C_{1-4}$—alkoxy, $C_{1-4}$—alkoxy—$C_{1-4}$alkoxy, $C_{1-4}$—alkyl—CO—, $C_{1-4}$—alkoxy—CO—, $C_{1-4}$—alkyl—COO—, $C_{1-4}$—alkoxy—$C_{1-4}$—alkoxy—CO—, $C_{1-4}$—alkoxy—COO—;

$R^6$ is selected from H, $C_{1-4}$—alkyl, $C_{1-4}$—alkoxy and $—NHCOT^11$ and $T^1$ is as defined in claim 2.

7. A transfer printing sheet according to claim 1 wherein E is a group of the formula:

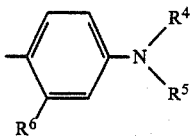

IV wherein $R^4$ and $R^5$ are independently selected from H, $C_{1-4}$—alkyl, aryl, $C_{4-8}$—cycloalkyl and $C_{1-4}$—alkyl substituted by a group selected from OH, CN, halogen, aryl, $C_{1-4}$—alkoxy, $C_{1-4}$—alkoxy—$C_{1-4}$—alkoxy, $C_{1-4}$—alkyl—CO—, $C_{1-4}$—alkoxy—CO—, $C_{1-4}$—alkyl—COO—, $C_{1-4}$—alkoxy—$C_{1-4}$—alkoxy—CO—, $C_{1-4}$—alkoxy—COO—;

$R^6$ is selected from H, $C_{1-4}$—alkyl, $C_{1-4}$—alkoxy and —$NHCOT^1$;

and $T^1$ is as defined in claim 2.

8. A transfer sheet according to claim 1 wherein the dye is of the formula:

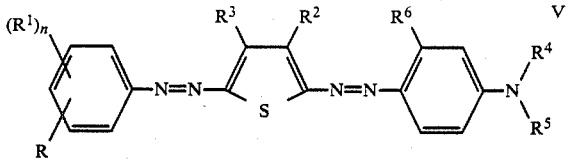

V wherein

R is selected from H; —CN; —$NO_2$; —$CONT_2$—; —$SO_2NT_2$; —$COT^1$; —$SO_2T^1$; $COOT^2$ and $SO_2OT^2$;

each $R^1$ is independently selected from H; halogen; $C_{1-4}$—alkyl; $C_{1-4}$—alkoxy; —$NT_2$ and $CF_3$;

n is 1, 2 or 3;

$R^2$ is selected from CN, —$COT^1$, —$CONT_2$ and $COOT^1$;

$R^3$ is H or $C_{1-4}$—alkyl;

$R^4$ and $R^5$ are independently selected from H, $C_{1-4}$—alkyl, phenyl, $C_{4-8}$—cycloalkyl and $C_{1-4}$—alkyl substituted by a group selected from OH, CN, $C_{1-4}$—alkoxy, $C_{1-4}$—alkoxy—$C_{1-4}$—alkoxy, $C_{1-4}$—alkyl—CO—, $C_{1-4}$—alkoxy—CO—, $C_{1-4}$—alkyl—COO—, halogen, $C_{1-4}$—alkoxy—$C_{1-4}$—alkoxy—CO—, $C_{1-4}$—alkoxy—COO— and phenyl; $R^6$ is selected from H, $C_{1-4}$—alkyl, $C_{1-4}$—alkoxy and —$NHCOT^1$; and T, $T^1$ and $T^2$ are as defined in claim 1.

9. A transfer sheet according to claim 8 wherein R and $R^3$ are H, n is 2 and each $R^1$ is independently selected from H; halogen; $C_{1-4}$—alkyl; $CF_3$ and $C_{1-4}$—alkoxy.

10. A transfer printing process which comprises contacting a transfer sheet according to any one of claims 1 to 6 or 8 to 10 with a receiver sheet, so that the dye is adjacent to the receiver sheet, and selectively heating an area of the transfer sheet at a temperature from 200° C. to 400° C. for a period of 0.5 to 20 milliseconds whereby dye in the heated area of the transfer sheet may be selectively transferred to the receiver sheet.

* * * * *

UNITED STATES PATENT AND TRADEMARK OFFICE

CERTIFICATE OF CORRECTION

PATENT NO. : 4,743,581

DATED : May 10, 1988

INVENTOR(S) : GREGORY

It is certified that error appears in the above-identified patent and that said Letters Patent is hereby corrected as shown below:

Title page item [30]:

Priority document number should read -- 8524154 --.

Signed and Sealed this

Twenty-first Day of February, 1989

*Attest:*

DONALD J. QUIGG

*Attesting Officer*

*Commissioner of Patents and Trademarks*